US005128281A

United States Patent [19]

Dyer et al.

[11] Patent Number: 5,128,281

[45] Date of Patent: Jul. 7, 1992

[54] METHOD FOR POLISHING SEMICONDUCTOR WAFER EDGES

[75] Inventors: Lawrence D. Dyer, Richardson; Anthony E. Stephens; Frank Allen, both of Sherman; Keith M. Easton, Plano; James A. Kennon, Denison; Jerry B. Medders, Van Alstyne; Frederick O. Meyer, III, Sherman, all of Tex.

[73] Assignee: Texas Instruments Incorporated, Dallas, Tex.

[21] Appl. No.: 711,468

[22] Filed: Jun. 5, 1991

[51] Int. Cl.[5] ..... H01L 21/22

[52] U.S. Cl. ..... 437/225; 437/974; 437/231; 156/645

[58] Field of Search ..... 437/225, 974, 947, 231, 437/228; 51/283 R, 283 E, 284 E; 156/645, 627, 626

[56] References Cited

U.S. PATENT DOCUMENTS

| | | | |
|---|---|---|---|
| 4,588,473 | 5/1986 | Hisatomi et al. | 156/636 |
| 4,718,202 | 1/1988 | Worsham | 51/283 E |
| 4,793,102 | 12/1988 | Dlouhy | 51/283 E |
| 4,864,779 | 9/1989 | Ozaki | 51/283 E |
| 4,879,258 | 11/1989 | Fisher | 156/645 |
| 4,897,369 | 1/1990 | Beretta et al. | 437/225 |
| 4,910,155 | 3/1990 | Cote et al. | 437/225 |

*Primary Examiner*—Brian E. Hearn
*Assistant Examiner*—Michael Trinh
*Attorney, Agent, or Firm*—B. Peter Barndt; Richard L. Donaldson

[57] ABSTRACT

A method for polishing the edges of a plurality of semiconductor wafers rotates a stack of wafers against a polish one or more pads such that both the wafer edges and the sides of the edges are polished to a mirror finish. The polish pad has a series of grooves through which the wafer edges are passed to polish the sides of the wafer edges, or two pads are used, one with grooves and one without grooves.

7 Claims, 2 Drawing Sheets

METHOD FOR POLISHING SEMICONDUCTOR WAFER EDGES

FIELD OF THE INVENTION

This invention relates to semiconductor material, and more particularly to an apparatus and method for polishing semiconductor wafer edges.

BACKGROUND OF THE INVENTION

During the manufacture of semiconductor wafers, the edge of the wafer is ground to a rounded or beveled profile by means of an abrasive wheel. The rounded edge reduces chipping during later process steps. The grinding wheel usually contains diamond abrasive ranging in particle size form 30 to 40 micrometers, and leaves a surface that has visible ridges and valleys as seen under a low power microscope. It is known that a smoother edge surface is needed in integrated circuit manufacturing. Smoother edges are needed because wafers with rough edges chip more easily, edge ground wafers contain deeper micro cracks than edge polished wafers, and edge ground wafers contain depressions that may be a source of particles in processes that use phosphorous glasses.

Present polishing processes include mechanically abrading wafers with a finer abrasive, dipping the wafer in an acid polishing mixture, treating the wafer edges with an acid polishing mixture, or by dripping or spraying an etchant onto the edge. Mechanical abrasion has the disadvantage that it does not produce a mirror finish. Dipping the entire wafer in acid leads to the rounding of the planar surfaces of the wafer unless extreme care is exercised in the process. Acid etching of the edge requires considerable removal of material for etching a smooth surface, which causes a problem with maintaining an optimum profile for the wafer.

BRIEF SUMMARY OF THE INVENTION

The invention is an apparatus and method for polishing the edges of a plurality of semiconductor wafers at one time. A plurality of wafers alternating with spacers are held together with the surfaces protected and rotated against a polishing surface to which is applied a polish slurry that is used during the polishing of wafer surfaces. The process is a combination chemo-mechanical process in that the exposed edge surface of each wafer is chemically converted to a coating of silicate and the top part of the coating is removed mechanically by very fine hydrated silica gel particles on a polishing pad.

A preferred embodiment of the invention is to have an abrasive polish cylinder come into contact with the edges of the wafers prior to the application of the chemo-mechanical polishing surface and slurry, thus putting a finer finish on the wafer than results from the edge grinding process, and thus removing some of the damage depth of the preceding process.

The chemo-mechanical polishing pad, which may be in cylindrical form, is rotated against the edges of the wafers. The wafers may also be rotating. The wafers are processed at an elevated temperature, between 35 and 60 degrees Centigrade.

In order to properly polish and shape the wafer edges, the wafers may be moved back and forth with respect to the polishing surface so that beveled edges may be polished as well as the outer parts of the edge. The polishing pad may have grooves partially around the polishing surface so that each wafer edge is in a groove, part of the time, to polish the beveled edge and against a nominally flat surface part of the time to polish the outer surface or crown of the edge. Alternately, the wafers may have the crown polished by one pad and the bevels by another pad that is fully grooved.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
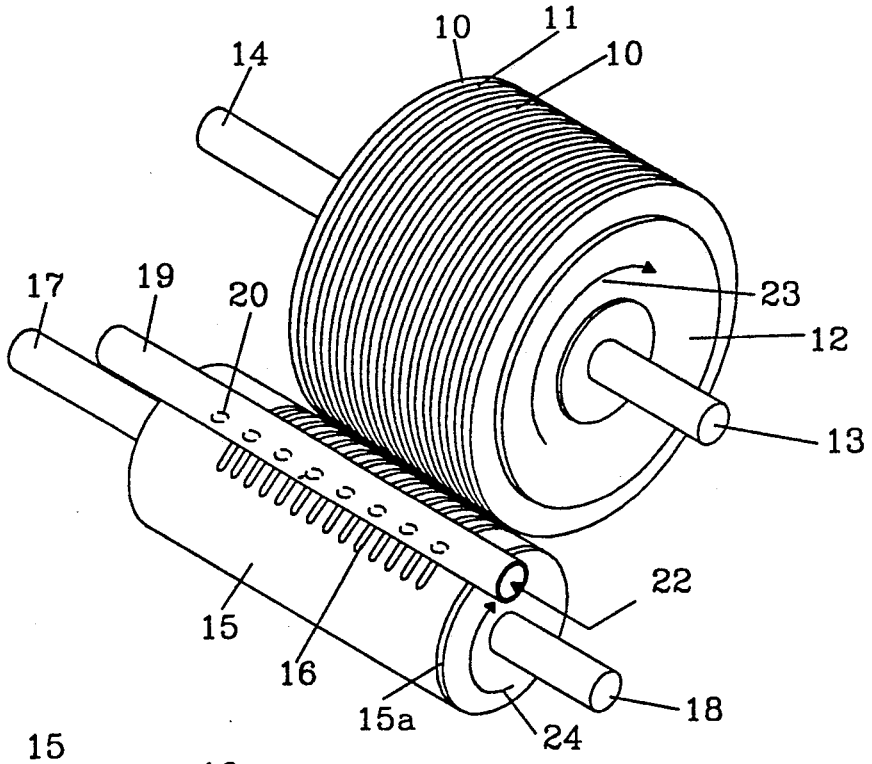
FIG. 1 is a simplified view of one embodiment of the invention.

FIG. 1 is a simplified illustration of the present invention. A plurality of semiconductor wafers 10 are held together by clamping plates 12 which rotate around shafts 13 and 14. The wafers have spacers 11 sandwiched between the wafers. The stack of wafers are rotated, for example, in the direction of arrow 23.

The wafers are rotated against roller 15 which has a pad 15*a* on it surface. The wafer edges are in contact with pad 15*a*. Roller 15 is rotated by shafts 17 and 18, for example, in the direction of arrow 24. As the wafers and roller are rotated, a chemo-mechanical slurry mixture is applied by dispenser 19 through holes 20. Slurry is introduced into dispenser at its end, as shown by arrow 22.

Roller pad 15*a* has a series of grooves 16 that extend into the surface of the pad and partially around the outer circumference of pad 15*a*. Grooves 16 are spaced such that an edge of a wafer enters a groove as the wafers and roller are rotated. The edge of a wafer is in a groove only during a part of a complete rotation since each groove does not extend completely around the outer circumference of pad 15*a*. A roller 15 rotates, the edges of the semiconductor wafers are moved into and out of grooves 16 alternately polishing the edge and the sides of the edge to provide a polished tapered edge on the semiconductor wafer.

Figure 2:
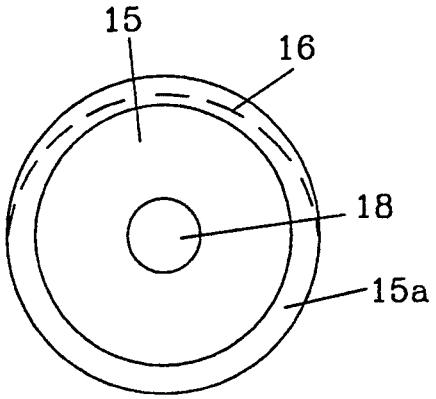
FIG. 2; is a polishing roller used in the invention.

FIG. 2 show an end view of roller 15, illustrating grooves 16. Grooves 16 extend half-way around pad 15*a* such that when roller 15 rotates against wafers 10, the edges of wafers 10 ride in and out of grooves 16 alternately polishing the edges and sides of the edges of the wafers.

Figure 3:
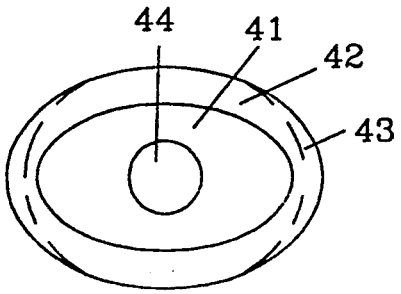
FIG. 3 is a second embodiment of a polishing roller.

FIG. 3 illustrates another embodiment of a polishing roller. Roller 41 is elliptical and has an elliptical polishing pad. Grooves 43 are in the end of the elliptical pad such that when roller 41 is rotated against the semiconductor wafers, the edges of the wafers extend into the pad, polishing the sides of the wafer edge twice during one rotation of pad 42 and the edge of the wafer is polished twice during one rotation. The alternating polishing action of pad 41 produces a finished polished tapered and round edge of the wafer.

Figure 4:
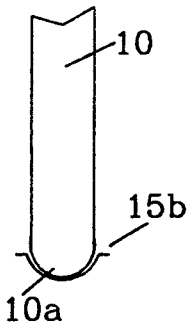
FIG. 4 illustrates the edge of an unpolished semiconductor wafer.
Figure 5:
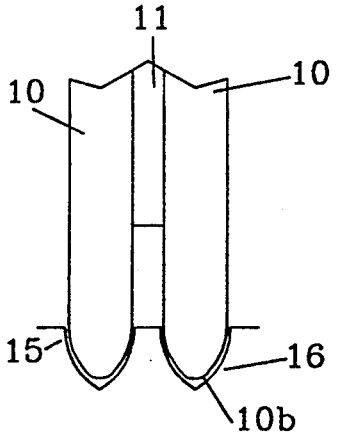
FIG. 5 illustrates two semiconductors in polishing grooves.

FIG. 4 shows the edge 10*a* of wafer 10 against the flat surface 15*b* of pad 15 and FIG. 5 shows two wafers 10 in grooves 16 of pad 15, polishing the sides 10*b* of wafer 10. The alternating polishing of the edges and sides of the edges produces the taper or rounded wafer edge as illustrated in FIG. 5.

A chemo-mechanical polishing slurry is applied to each of the above illustrated polishing pads. Other embodiments may be used for polishing pads such as a continuous band or belt of polishing material, or a flat disk rotating under and against the wafer edges.

A preferred embodiment of the invention is to have an abrasive polish cylinder come into contact with the edges of the wafers prior to the application of the chemo-mechanical polishing surface and slurry, thus putting a finer finish on the wafer than results from the edge grinding process, and thus removing some of the damage depth of the preceding process.

Figure 6:
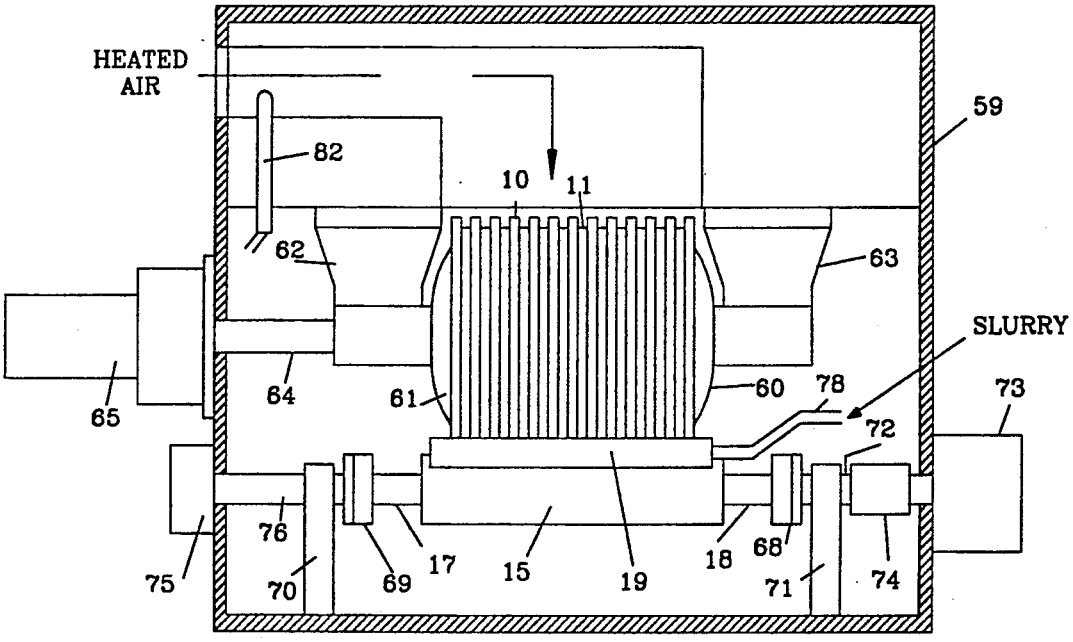
FIG. 6 illustrates a polishing system according to the present invention.

FIG. 6 is a polishing system according to the present invention. A plurality of semiconductor wafers 10 are stacked together with spacers 11 and held between clamping plates 60 and 61. Each clamping plated 60 and 61 are rotatably fastened to a movable mount. Plate 60 is attached to mount 63 and plate 61 is attached to mount 62. Mounts 62 and 63 are movable away from each other so that a stack of wafers, held between plates 60 and 61 can be rotatably mounted in the mounts. A shaft 64 is coupled to a shaft (not illustrated) in mount 62. Shaft 64 is also coupled to motor 65. Motor 65 rotates wafers 10 when motor 65 is turned on. Housing 59 encloses the polishing apparatus.

Polishing pad 15 is rotatably mounted on shafts 18 and 18 which are coupled to disconnect couplers 68 and 69, respectfully. Disconnect coupler 68 is connected to coupler 74 via shaft 72. Coupler 74 connects shaft 72 to motor 73. Shaft 72 is supported by mount 71. Shaft 17 connected to disconnect 69, connected to shaft 76. Shaft 76 is supported by bearing 75. Shaft 76 is supported by mount 70. Both mounts 70 and 71 have bearings (not illustrated) through which shaft 72, for mount 71 and shaft 76, for mount 70, extends through. Motor 73 rotates polishing pad 15.

Dispenser 19 is mounted above polishing pad 15 and dispenses the chemo-mechanical slurry. The slurry is pumped through tube 78 and is applied to pad 15 so that the edges of wafers are polished as the wafers rotate against polishing pad 15.

Heated air is circulated across the semiconductor wafers as shown by arrow 81. Temperature of the air is monitored by thermometer. Thermometer 82 may be connected to control the temperature of the heated air stream.

Polishing of the wafer edges is effected by rotating the wafers against the polishing pad/roller while a chemo-mechanical polish slurry is being applied. The edges of the wafers are introduced into grooves to polish the sides of the edge to maintain a tapered shape. The wafers are rotating slowly with the polishing roller rotating at a much faster rate. Polishing can be accomplished with one rotation of the wafers while the polishing roller rotates many revolutions alternately polishing the edge and then the sides of the edge of the wafer as the wafer edges pass through the groves in the polish roller. The speed of the wafers may be, for example, between 0.02 and 50 rpm, and the speed of the polishing pad may be, for example, 600 rpm.

In one example the wafers were elevated to a temperature between 35 and 60 degree centigrade with the heated air. Slurry was applied at a rate of about 7 drops per minute from each opening in the slurry dispenser. The slurry was maintained at a temperature of about 50 +/−3 degrees centigrade. Polishing time was about 20 minutes.

The polish pad 15 can be of different configurations. It can be cylindrical shaped, with a pad of material around a cylindrical mandrel. The pad may also be a continuous roll of pad driven by two rollers. In another embodiment, a flat plate may used with a pad on its surface.

The pad may be an elastomer such as urethane, rubber or silicone or a combination of layers of materials. One example is to use a napped poromeric urethane pad.

The slurry, which is heated, may have a chemical base added so that the pH is a value between 9 and 14. The slurry contains a silica dispersion with a stabilizing agent.

What is claimed is:

1. A method of polishing edges of a plurality of semiconductor wafers and providing a tapered, polished edge, comprising the steps of:

securing a plurality of semiconductor wafers together with clamping plates having shafts mounted thereof, and spacers between adjacent wafers;

rotating the wafers around said shafts;

engaging the edges of the rotating wafers with a polishing pad; and applying a polishing slurry to the polishing pad.

2. The method according to claim 1, including rotating the wafers around said shafts such that the edges of the wafers are rotated through grooves in the polishing pad.

3. The method according to claim 1, including maintaining the pH of the slurry between 9 and 14.

4. The method according to claim 1, including the step of rotating the polishing pad in a direction opposite to the rotation of said wafers.

5. The method according to claim 1 including the step of heating the wafers with heated air during polishing.

6. The method according to claim 1, wherein the slurry is of hydrated silica gel particles.

7. The method according to claim 1, wherein the slurry is heated to approximately 50 degrees centigrade and polishing is accomplished in approximately 20 minutes.

* * * * *